United States Patent [19]

Kukes et al.

[11] Patent Number: 4,940,530

[45] **Date of Patent: * Jul. 10, 1990**

[54] TWO-STAGE HYDROCARBON CONVERSION PROCESS

[75] Inventors: Simon G. Kukes, Naperville, Ill.; Albert L. Hensley, Jr., Munster, Ind.; Jeffrey C. Kelterborn, Hinsdale; James L. Aderhold, Wheaton, both of Ill.

[73] Assignee: Amoco Corporation, Chicago, Ill.

[ * ] Notice: The portion of the term of this patent subsequent to Mar. 14, 2006 has been disclaimed.

[21] Appl. No.: 312,205

[22] Filed: Feb. 21, 1989

[51] Int. Cl.[5] ..... C10G 65/12

[52] U.S. Cl. ..... 208/89; 208/111; 208/114

[58] Field of Search ..... 208/89, 68, 111, 114

[56] References Cited

U.S. PATENT DOCUMENTS

| | | | |
|---|---|---|---|
| 3,963,600 | 6/1976 | Hilfman | 208/59 |
| 4,183,801 | 1/1980 | Breuker et al. | 208/89 |
| 4,604,187 | 8/1986 | Ward | 208/111 |
| 4,743,355 | 5/1988 | Ward | 208/89 |
| 4,746,419 | 5/1988 | Peck et al. | 208/59 |
| 4,789,457 | 12/1988 | Fischer et al. | 208/68 |
| 4,797,195 | 1/1989 | Kukes et al. | 208/111 |
| 4,797,196 | 1/1989 | Kukes et al. | 208/111 |
| 4,812,224 | 3/1989 | Miller | 208/68 |
| 4,820,403 | 4/1989 | Gutberlet et al. | 208/68 |
| 4,828,676 | 5/1989 | Sawyer et al. | 208/59 |
| 4,834,865 | 5/1989 | Kukes et al. | 208/59 |

*Primary Examiner*—Anthony McFarlane

*Attorney, Agent, or Firm*—Ekkehard Schoettle; William H. Magidson; Ralph C. Medhurst

[57] ABSTRACT

A two-stage hydrocarbon process is disclosed wherein a hydrocarbon feedstock is first hydrotreated followed by a hydrocracking step wherein a portion of the hydrotreated feedstock is hydrocracked in the presence of a catalyst having a nickel component, a tungsten component, and a support component containing a crystalline molecular sieve material present in an amount ranging from 25 to 60 wt. % based on the weight of the support component with the balance being alumina.

15 Claims, No Drawings

TWO-STAGE HYDROCARBON CONVERSION PROCESS

BACKGROUND OF THE INVENTION

The present invention relates to a hydrocarbon conversion process. More particularly, this invention relates to the catalytic hydrocracking of hydrocarbons.

The hydrocracking of hydrocarbons is old and well-known in the prior art. These hydrocracking processes can be used to hydrocrack various hydrocarbon fractions such as reduced crudes, gas oils, heavy gas oils, topped crudes, shale oil, coal extract and tar extract wherein these fractions may or may not contain nitrogen compounds. Modern hydrocracking processes were developed primarily to process feeds having a high content of polycyclic aromatic compounds, which are relatively unreactive in catalytic cracking. The hydrocracking process is used to produce desirable products such as turbine fuel, diesel fuel, and middle distillate products such as naphtha and gasoline.

The hydrocracking process is generally carried out in any suitable reaction vessel under elevated temperatures and pressures in the presence of hydrogen and a hydrocracking catalyst so as to yield a product containing the desired distribution of hydrocarbon products.

Hydrocracking catalysts generally comprise a hydrogenation component on an acidic cracking support More specifically, hydrocracking catalysts comprise a hydrogenation component selected from the group consisting of Group VIA metals and Group VIII metals of the Periodic Table of Elements, their oxides or sulfides. The prior art has also taught that these hydrocracking catalysts contain an acidic support comprising a crystalline alumino silicate material such as X-type and Y-type alumino silicate materials. This crystalline aluminosilicate material is generally suspended in a refractory inorganic oxide such as silica, alumina, or silica-alumina.

The preferred Group VIA metals are tungsten and molybdenum the preferred Group VIII metals are nickel and cobalt.

The prior art has also taught that combinations of metals for the hydrogenation component, expressed as oxides and in the order of preference, are: $NiO_3$, $NiO$-$MoO_3$, $CoO$-$MoO_3$, and $CoO$-$WO_3$.

Other hydrogenation components broadly taught by the prior art include iron, ruthenium, rhodium, palladium, osmium, indium, platinum, chromium, molybdenum, vanadium, niobium, and tantalum.

References that disclose hydrocracking catalysts utilizing nickel and tungsten as hydrogenation components, teach enhanced hydrocracking activity when the matrix or catalyst support contains silica-alumina. For instance, U.S. Pat. Nos. 4,576,711, 4,563,434, and 4,517,073 all to Ward et al., show at Table V thereof that the lowest hydrocracking activity is achieved when alumina is used in the support instead of a dispersion of silica-alumina in alumina. The lowest hydrocracking activity is indicated by the highest reactor temperature required to achieve 60 vol. % conversion of the hydrocarbon components boiling above a predetermined boiling range temperature end point to below that boiling range temperature end point.

Similarly, U.S. Pat. No. 3,536,605 to Kittrell et al. teaches the use of silica-alumina in the catalyst support when a nickel- and tungsten-containing hydrogenation component is employed.

U.S. Pat. No. 3,598,719 to White teaches a hydrocracking catalyst that can contain no silica; however, the patent does not present an example showing the preparation of a catalyst devoid of silica nor does the patent teach the preferential use of nickel and tungsten as hydrogenation metals.

As can be appreciated from the above, there is a myriad of catalysts known for hydrocracking whose catalytic properties vary widely. A catalyst suitable for maximizing naphtha yield may not be suitable for maximizing the yield of turbine fuel. Further, the degree of cracking and yield structure is also dependent upon the feedstock composition.

Catalysts of high hydrogenation activity relative to acidity yield more highly saturated products as required in distillate fuels such as jet or aviation fuel.

Reconciling hydrodenitrogenation activity with hydrocracking activity in a single hydrocracking catalyst presents a difficulty. For instance when a feedstock having a high nitrogen content is exposed to a hydrocracking catalyst containing a high amount of cracking component the nitrogen serves to poison or deactivate the cracking component. Another difficulty is presented when the hydrocracking process is used to maximize naphtha yields from a feedstock containing light catalytic cycle oil which has a very high aromatics content. The saturation properties of the catalyst must be carefully gauged to saturate only one aromatic ring of a polynuclear aromatic compound such as naphthalene in order to preserve desirable high octane value aromatic-containing hydrocarbons for the naphtha fraction. If the saturation activity is too high, all of the aromatic rings will be saturated and subsequently cracked to lower octane value paraffins.

On the other hand, distillate fuels such as diesel fuel or aviation fuel have specifications that stipulate a low aromatics content. This is due to the undesirable smoke production caused by the combustion of aromatics in diesel engines and jet engines.

Prior art processes designed to convert high nitrogen content feedstocks and produce jet fuel are usually two stage processes wherein the first stage is designed to convert organic nitrogen compounds to ammonia prior to contacting with a hydrocracking catalyst which contained a high amount of cracking component; e.g., a molecular sieve material.

For instance U.S. Pat. No. 3,923,638 to Bertolacini et al. discloses a two catalyst process suitable for converting a hydrocarbon containing substantial amounts of nitrogen to saturated products adequate for use as jet fuel. Specifically, the subject patent discloses a process wherein the hydrodenitrogenation catalyst comprises as a hydrogenation component a Group VIA metal and group VIII metal and/or their compounds and a cocatalytic acidic support comprising a large-pore crystalline aluminosilicate material and refractory inorganic oxide. The hydrocracking catalyst comprises as a hydrogenation component a Group VIA metal and a Group VIII metal and/or their compounds, and an acidic support of large-pore crystalline aluminosilicate material. For both hydrodenitrogenation catalyst and the hydrocracking catalyst, the preferred hydrogenation component comprises nickel and tungsten and/or their compounds and the preferred large-pore crystalline aluminosilicate material is ultrastable Y, large-pore crystalline aluminosilicate material.

A two-stage process suitable for maximizing gasoline-boiling range products is disclosed in U.S. Pat. No. 3,649,523 to Bertolacini et al. The disclosed first stage is a hydrotreating stage wherein nitrogen and sulfur are removed from the feedstock followed by a hydrocracking stage employing a catalyst containing a Group VIA metal, a Group VIII metal, a large-pore crystalline aluminosilicate material, and a porous support selected from the group consisting of alumina, aluminum-phosphate, and silica. The patent exemplifies several cobalt molybdenum-containing catalysts with the one containing a silica-alumina matrix material possessing the highest activity.

It has also been discovered that denitrogenation, hydrocracking, and polyaromatic saturation activities can be maximized with a single catalyst system when treating a feedstock containing highly aromatic light catalytic cycle oil. Specifically, application Nov. 124,280 filed on Nov. 23, 1987, the teachings of which are incorporated herein by reference, discloses a catalyst comprising a combination of a nickel component, and a tungsten component coupled with a support component comprising a crystalline molecular sieve material component, and an alumina component. This catalyst system has been discovered to provide increased selectivity towards high octane naphtha with decreased undesirable selectivity towards $C_1$ to $C_5$ light gas.

It has now been discovered that the activity of the above-described hydrocracking process can be markedly increased by hydrotreating the feedstock prior to passing it to the hydrocracking process.

An attendant advantage of increasing the activity of the catalyst in the hydrocracking stage is the ability to increase the throughput of feed to the hydrocracking process unit.

The process of the invention also surprisingly yields a naphtha fraction having a high octane affording aromatics content. The amount of desirable aromatics produced by the process of the invention is significantly higher than when the feedstock is hydrocracked without an initial hydrotreatment step.

SUMMARY OF THE INVENTION

This invention relates to a multiple stage process wherein a hydrocarbon feedstock comprising a light catalytic cycle oil containing nitrogen- and sulfur-containing compounds is first hydrotreated in a hydrotreating stage comprising a hydrotreating reaction zone wherein hydrogen is contacted with the feedstock in the presence of a hydrotreating catalyst at hydrotreating conditions wherein a substantial portion of the nitrogen- and sulfur-containing compounds are converted to hydrogen sulfide and ammonia.

At least a portion of the hydrotreating stage is then passed to a stripping zone wherein hydrogen sulfide and ammonia are removed to form a stripping zone effluent.

At least a portion of the stripping zone effluent is then passed to a hydrocracking stage. Specifically, the stripping zone effluent is then contacted with hydrogen at hydrocarbon hydrocracking conversion conditions in the presence of a catalytic composite comprising a combination of a nickel component, and a tungsten component, wherein the nickel component is present in an amount ranging from about 1 to about 10 wt. % and the tungsten component is present in an amount ranging from about 10 to 30 wt. % calculated as oxides and based on total catalyst weight. The catalytic composite also contains a support component comprising a crystalline molecular sieve material component, and an alumina component wherein the crystalline molecular sieve material is present in the support in an amount ranging from about 25 to 60 wt. % based on the weight of the support component.

DETAILED DESCRIPTION OF THE INVENTION

The hydrocarbon feedstock suitable for use in accordance with the process of this invention is selected from the group consisting of petroleum distillates, solvent deasphalted petroleum residua, shale oils and coal tar distillates. These feedstocks typically have a boiling range above about 200° F. and generally have a boiling range between 350° to 950° F. More specifically these feedstocks include heavy distillates, heavy straight-run gas oils and heavy cracked cycle oils, as well as fluidized catalytic cracking unit feeds.

The process of the invention is especially suitable in connection with handling feeds that include a light catalytic cycle oil. This light catalytic cycle oil generally has a boiling range of about 350° to about 750° F., a sulfur content of about 0.3 to about 2.5 wt %, a nitrogen content of about 0.01 to about 0.15 wt % and an aromatics content of about 40 to about 90 vol. %. The light catalytic cycle oil is a product of the catalytic cracking process.

In accordance with the process of the invention, the above-described feedstock is first contacted with a hydrotreating catalyst in hydrotreating stage at hydrotreating conditions.

Suitable operating conditions in the hydrotreating stage are summarized below:

HYDROTREATING OPERATING CONDITIONS

| Conditions | Broad Range | Preferred Range |
|---|---|---|
| Temperature, °F. | 400–850 | 500–750 |
| Total pressure, psig | 50–4,000 | 400–1800 |
| LHSV | .10–20 | .25–2.5 |
| Hydrogen rate, SCFB | 500–20,000 | 800–6,000 |
| Hydrogen partial pressure, psig | 50–3,500 | 500–1,000 |

The hydrotreater stage is also preferably operated at conditions that will result in an effluent stream having less than 10 ppmw nitrogen-containing impurities, based on nitrogen, and less than 20 ppmw sulfur-containing compounds or impurities, based on sulfur, and most preferably less than 5 ppmw and 10 ppmw, respectively. The above-set out preferred nitrogen and sulfur contents correspond to substantial conversion of the sulfur and nitrogen compounds entering the hydrotreater to hydrogen sulfide and ammonia.

The catalyst employed in the hydrotreater can be any conventional and commercially available hydrotreating catalyst. The subject hydrotreating catalysts typically contain one or more elements from Groups IIB, VIB, and VIII supported on an inorganic refractory support such as alumina. Catalysts containing NiMo, NiMoP, CoMo, CoMoP, and NiW are most prevalent.

Other suitable hydrotreating catalysts for the hydrotreating stage of the present invention comprise a Group VIB metal component or non-noble metal component of Group VIII and mixtures thereof, such as cobalt, molybdenum, nickel, tungsten and mixtures thereof. Suitable supports include inorganic oxides such as alumina, amorphous silica-alumina, zirconia, magnesia, boria, titania, chromia, beryllia, and mixtures thereof. A preferred hydrotreating catalyst contains sulfides or oxides of Ni and Mo composited with an alumina support wherein the Ni and Mo are present in amounts ranging from 0.1 wt. % to 10 wt. % calculated as NiO and 1 wt. % to 20 wt. % calculated as $MoO_3$ based on total catalyst weight.

Prior to passing the hydrotreating stage effluent to the hydrocracking stage, the $H_2S$ and $NH_3$ are stripped from the hydrotreating stage effluent in a conventional manner in any suitable gas-liquid separation zone.

Operating conditions to be used in the hydrocracking reaction zone include an average catalyst bed temperature within the range of about 500° to 1000° F., preferably 600° to 900° F. and most preferably about 650° to about 850° F., a liquid hourly space velocity within the range of about 0.1 to about 10 volumes hydrocarbon per hour per volume catalyst, a total pressure within the range of about 500 psig to about 5,000 psig, and a hydrogen circulation rate of about 500 standard cubic feet to about 20,000 standard cubic feet per barrel.

The process of the present invention is naphtha selective with decreased production of light gases. Further, the process of the invention provides for a distillate product fraction that is sufficiently low in aromatic content such that it can be used as a blending component to prepare or be directly used as diesel fuel or aviation fuel.

The hydrocracking stage of the process of the present invention is preferably carried out in a single reaction zone wherein the reaction zone can comprise a plurality of catalyst beds. Each catalyst bed can have intrabed quench to control temperature rise due to the exothermic nature of the hydrocracking reactions. The charge stock may be a liquid, vapor, or liquid-vapor phase mixture, depending upon the temperature, pressure, proportion of hydrogen, and particular boiling range of the charge stock processed. The source of the hydrogen being admixed can comprise a hydrogen-rich gas stream obtained from a catalytic reforming unit.

The catalyst used in the hydrocracking stage of the process of the present invention comprises a hydrogenation component and a catalyst support.

The hydrogenation component used in the hydrocracking stage catalyst comprises nickel and tungsten and/or their compounds. The nickel and tungsten are present in the amounts specified below. These amounts are based on the total catalytic composite or catalyst weight and are calculated as the oxides, NiO and $WO_3$. In another embodiment the hydrogenation component can additionally comprise a phosphorus component. The amount of phosphorus component is calculated as $P_2O_5$ with the ranges thereof also set out below.

| | Broad | Preferred | Most Preferred |
|---|---|---|---|
| NiO, wt % | 1–10 | 1.5–5.0 | 1.5–4.0 |
| $WO_3$, wt % | 10–30 | 15–25 | 15–20 |
| $P_2O_5$, wt % | 0.0–5.0 | 0.0–2.0 | 0.0–1.0 |

The hydrogenation component may be deposited upon the support by impregnation employing heat-decomposable salts of the above-described metals or any other method known to those skilled in the art. Each of the metals may be impregnated onto the support separately, or they may be co-impregnated onto the support. The composite is subsequently dried and calcined to decompose the salts and to remove the undesired anions.

Another component of the hydrocracking catalytic composite or catalyst is the support. The support comprises a crystalline molecular sieve material and alumina. The preferred alumina is gamma alumina. The crystalline molecular sieve material is present in an amount ranging from about 25 to about 60 wt. %, preferably from about 35 to about 50 wt. %.

Preferably, the crystalline molecular sieve material is distributed throughout and suspended in a porous matrix of the alumina. The hydrocracking catalyst contains alumina in the catalyst support in contradistinction to U.S. Pat. Nos. 4,576,711, 4,563,434, and 4,517,073 to Ward et al. and U.S. Pat. No. 3,536,605 to Kittrell et al. which require the presence of silica-alumina matrix material.

The support may be prepared by various well-known methods and formed into pellets, beads, and extrudates of the desired size. For example, the crystalline molecular sieve material may be pulverized into finely divided material, and this latter material may be intimately admixed with the gamma alumina. The finely divided crystalline molecular sieve material may be admixed thoroughly with a hydrosol or hydrogel of the gamma alumina. Where a thoroughly blended hydrogel is obtained, this hydrogel may be dried and broken into pieces of desired shapes and sizes. The hydrogel may also be formed into small spherical particles by conventional spray drying techniques or equivalent means.

The molecular sieve materials of the invention preferably are selected from the group consisting of a faujasite-type crystalline aluminosilicate, and mordenite-type crystalline aluminosilicate. Although not preferred, crystalline aluminosilicates such as ZSM-5, ZSM-11, ZSM-12, ZSM-23 and ZSM-35 and crystalline borosilicates such as AMS-1B can also be used with varying results alone or in combination with the faujasite-type or mordenite-type crystalline aluminosilicate. Also suitable for use are gallosilicates in conjunction with another molecular sieve component. Specifically, application Ser. No. 287,399 filed December 20, 1988, discloses a hydrocracking catalyst containing a crystalline molecular sieve material present in an amount ranging from about 25 to about 60 wt. % based on the weight of the support component wherein at least about 1 to about 80 wt. % of the sieve material is a gallosilicate.

Examples of a faujasite-type crystalline aluminosilicate are high- and low-alkali metal Y-type crystalline aluminosilicates, metal-exchanged X-type and Y-type crystalline aluminosilicates, and ultrastable, large-pore crystalline aluminosilicate material. Zeolon is an example of a mordenite-type crystalline aluminosilicate.

An ultrastable, large-pore crystalline aluminosilicate material is represented by Z-14US zeolites which are described in U.S. Pat. Nos. 3,293,192 and 3,449,070. Each of these patents is incorporated by reference herein and made a part hereof. By large-pore material is meant a material that has pores which are sufficiently large to permit the passage thereinto of benzene molecules and larger molecules and the passage therefrom of reaction products. For use in petroleum hydrocarbon conversion processes, it is often preferred to employ a large-pore molecular sieve material having a pore size of at least 5 Å (0.5 nm) to 10 Å (1 nm).

The ultrastable, large-pore crystalline aluminosilicate material is stable to exposure to elevated temperatures. This stability in elevated temperatures is discussed in the aforementioned U.S. Pat. Nos. 3,293,192 and 3,449,070. It may be demonstrated by a surface area measurement after calcination at 1,725° F. In addition, the ultrastable, large-pore crystalline aluminosilicate material exhibits extremely good stability toward wetting, which is defined as the ability of a particular aluminosilicate material to retain surface area or nitrogen-adsorption capacity after contact with water or water vapor. A sodium-form of the ultrastable, large-pore crystalline aluminosilicate material (about 2.15 wt. % sodium) was shown to have a loss in nitrogen-absorption capacity that is less than 2% per wetting, when tested for stability to wetting by subjecting the material to a number of consecutive cycles, each cycle consisting of a wetting and a drying.

An ultrastable, large-pore crystalline aluminosilicate material that is preferred for use in the hydrocracking catalyst of this invention exhibits a cubic unit cell dimension and hydroxyl infrared bands that distinguish it from other aluminosilicate materials. The cubic unit cell dimension of the preferred ultrastable, large-pore crystalline aluminosilicate is within the range of about 24.20 Angstrom units (Å) to about 24.55 Å. The hydroxyl infrared bands obtained with the preferred ultrastable, large-pore crystalline aluminosilicate material are a band near 3,745 $cm^{-1}$ (3,745±5 $cm^{-1}$), a band near 3,695 $cm^{-1}$ (3,690±10 $cm^{-1}$), and a band near 3,625 $cm^{-1}$ (3,610±15 $cm^{-1}$). The band near 3,745 $cm^{-1}$ may be found on many of the hydrogen-form and decationized aluminosilicate materials, but the band near 3,695 $cm^{-1}$ and the band near 3,625 $cm^{-1}$ are characteristic of the preferred ultrastable, large-pore crystalline aluminosilicate material that is used in the catalyst of the present invention.

The ultrastable, large-pore crystalline aluminosilicate material is characterized also by an alkaline metal content of less than 1%.

Other examples of crystalline molecular sieve zeolites that are suitable for the catalyst of the present invention are a high-sodium Y-type crystalline aluminosilicate such as the sodium-Y molecular sieve designated Catalyst Base 30-200 and obtained from the Linde Division of Union Carbide Corporation and a low-sodium Y-type molecular sieve designated as low-soda Diuturnal-Y-33-200 and obtained from the Linde Division of Union Carbide Corporation.

Another example of a crystalline molecular sieve zeolite that can be employed in the catalytic composition of the present invention is a metal-exchanged Y-type molecular sieve. Y-type zeolitic molecular sieves are discussed in U.S. Pat. No. 3,130,007. The metal-exchanged Y-type molecular sieve can be prepared by replacing the original cation associated with the molecular sieve by a variety of other cations according to techniques that are known in the art. Ion exchange techniques have been disclosed in many patents, several of which are U.S. Pat. Nos. 3,140,249, 3,140,251, and 3,140,253. Specifically, a mixture of rare earth metals can be exchanged into a Y-type zeolitic molecular sieve and such a rare earth metal-exchanged Y-type molecular sieve can be employed suitably in the catalytic composition of the present invention. Specific examples of suitable rare earth metals are cerium, lanthanum, and praseodymium.

As mentioned above, another molecular sieve that can be used in the catalytic composition of the present invention is AMS-1B crystalline borosilicate, which is described in U.S. Pat. No. 4,269,813, which patent is incorporated by reference herein and made a part thereof.

A suitable AMS-1B crystalline borosilicate is a molecular sieve material having the following composition in terms of mole ratios of oxides:

$$0.9\pm0.2\ M_{2/n}O:B_2O_3:YSiO_2:ZH_2O,$$

wherein M is at least one cation having a valence of n, Y is within the range of 4 to about 600, and Z is within the range of 0 to about 160, and providing an X-ray diffraction pattern comprising the following X-ray diffraction lines and assigned strengths:

| d(Å) | Assigned Strength |
|---|---|
| 11.2 ± 0.2 | W - VS |
| 10.0 ± 0.2 | W - MS |
| 5.97 ± 0.07 | W - M |
| 3.82 ± 0.05 | VS |
| 3.70 ± 0.05 | MS |
| 3.62 ± 0.05 | M - MS |
| 2.97 ± 0.02 | W - M |
| 1.99 ± 0.02 | VW - M |

Mordenite-type crystalline aluminosilicates can be employed in the catalyst of the present invention. Mordenite-type crystalline aluminosilicate zeolites have been discussed in patent art, e.g., by Kimberlin in U.S. Pat. No. 3,247,098, by Benesi, et al., in U.S. Pat. No. 3,281,483, and by Adams, et al., in U.S. Pat. No. 3,299,153. Those portions of each of these patents which portions are directed to mordenite-type aluminosilicates are incorporated by reference and made a part hereof.

In a preferred embodiment the catalyst situated at the downstream portion of the hydrocracking stage reaction zone possesses a small nominal size while the remaining upstream portion of the total amount of catalyst possesses a large nominal size greater than the small nominal size catalyst. Specifically, the small nominal size is defined as catalyst particles having a U.S. Sieve mesh size ranging from about 10 to 16 preferably 10 to 12. The large nominal size catalyst preferably ranges from about 5 to about 7 U.S. Sieve mesh size. Further details of this preferred embodiment are disclosed in U.S. Ser. No. 160,524, filed on Feb. 26, 1988, the teachings of which are incorporated by reference.

Generally, the small nominal size hydrocracking catalyst is present in an amount ranging from about 5 to 70 wt. % of the total overall amount of catalyst used in this invention. Preferably, this amount ranges from about 10 to about 60 wt. %.

The amount of small nominal size hydrocracking catalyst used in the hydrocracking stage can be limited in accordance with the desired overall pressure gradient. This amount can be readily calculated by those skilled in the art as explained in U.S. Pat. Nos. 3,796,655 (Armistead et al.) and 3,563,886 (Carlson et al.).

The present invention is described in further detail in connection with the following Examples, it being understood that these examples are for purposes of illustration and not limitation.

The present invention is described in further detail in connection with the following Example, it being understood that the example is for purposes of illustration and not limitation.

EXAMPLE 1

The present Example serves to demonstrate the importance of utilizing nickel, tungsten, alumina, and a molecular sieve component in the amounts prescribed by the present invention as compared with alternative processes utilizing hydrocracking catalysts of differing compositions.

Comparative catalysts and catalysts having nickel, tungsten, alumina, and a sieve component were used to convert a light catalytic cycle oil feedstock to naphtha and distillate products thereby determining the hydrodenitrogenation, hydrocracking, and polyaromatic saturation activities.

Table 1 below sets out the properties of the feedstock used in each test run.

TABLE 1

| Feed Properties | |
|---|---|
| API gravity | 21.9 |
| C, % | 88.58 |
| H, % | 10.37 |
| S, % | 0.55 |
| N, ppm | 485 |
| Total aromatics, wt % | 69.5 |
| Polyaromatics, wt % | 42.2 |
| Simulated distillation, °F. | |
| IBP, wt % | 321 |
| 10 | 409 |
| 25 | 453 |
| 50 | 521 |
| 75 | 594 |
| 90 | 643 |
| FBP | 756 |

The following Table 2 sets out the composition of each catalyst used in the present example to convert the feed described in Table 1. Catalysts B, C, and G contain nickel, tungsten, alumina and a molecular sieve component, specifically, an ultrastable Y sieve designated as "USY." Commercial catalyst (I) is a commercially available high activity hydrocracking catalyst. Commercial catalyst (II) is a commercially available denitrogenation catalyst.

TABLE 2

| Catalyst | Metals (wt %) | USY Sieve (%) | Support |
|---|---|---|---|
| A | $NiO(3.5)WO_3(18.0)$ | 0 | $\gamma$-$Al_2O_3$ |
| B | $NiO(2.0)WO_3(18.0)$ | 35 | $\gamma$-$Al_2O_3$ |
| C | $NiO(2.0)WO_3(18.0)$ | 50 | $\gamma$-$Al_2O_3$ |
| D | $NiO(2.0)WO_3(18.0)$ | 35 | $SiO_2$-$Al_2O_3$ |
| E | $NiO(3.0)MoO_3(18.0)$ P(1.5) | 35 | $\gamma$-$Al_2O_3$ |
| F | $CoO(3.0)MoO_3(10.0)$ | 35 | $SiO_2$-$Al_2O_3$ |
| G | $NiO(2.0)WO_3(18.0)$ $P_2O_5(0.75)$ | 35 | $Al_2O_3$ |
| H | $NiO(3.5)MoO_3(18.0)$ $P_2O_3(3.0)$ | 35 | $Al_2O_3$ |
| Commercial (I) | NiO $MoO_3$ | High | Unknown |
| Commercial (II) | NiO $MoO_3$ | 0 | $\gamma$-$Al_2O_3$ |

Each catalyst was first tested to determine its hydrodenitrogenation activity, and a polycyclic aromatic saturation activity.

The reaction conditions for hydrodenitrogenation (HDN) and polycyclic aromatic saturation include a temperature of 675° F., and pressure of 1250 psig. The test reactor contained 4.0 grams of catalyst crushed to a 14/20 mesh size for each test run. The feed rates were 40 g/hr and 60 g/hr for the hydrodenitrogenation tests and polycyclic aromatic saturation tests respectively.

Using Catalyst D as a reference for the determination of all activities, the relative activities for HDN were calculated by equation 1:

$$HDN\ \text{Act} = \frac{\log (N_F/N_P)}{\log (N_f/N_p)_{ref}} \quad (1)$$

$N_F$ and $N_P$ are the nitrogen concentration in the feed and product, respectively and $N_f$ and $N_p$ are the nitrogen concentration in the feed and product respectively for the reference catalyst. Similarly, the polyaromatic saturation activity (naphthalene saturation) was determined according to equation 2:

$$\text{Polyaromatic Saturation Act} = \frac{\log (Nap_F/Nap_P)}{\log (Nap_f/Nap_p)_{ref}} \quad (2)$$

$Nap_F$ and $Nap_P$ are the concentration of naphthalene in the feed and the product, respectively. $Nap_f$ and $Nap_p$ are the concentration of naphthalene in the feed and product respectively for the reference catalyst.

In order to determine the hydrocracking activity for each catalyst, the amount of catalyst used in each run was increased to 18.75 g. The catalyst used in each run was crushed to a 14/20 mesh size. Each test run was carried out at a temperature sufficient to obtain about 77 wt. % conversion of the reactor influent to material having a boiling range less than about 380° F. The WHSV was 1.6 and the reactor pressure was 1250 psig. The hydrocracking activity was determined by equation 3:

$$\text{Hydrocracking Act} = e^{-35{,}000/R\left(\frac{1}{T} - \frac{1}{T_{ref}}\right)} \quad (3)$$

In equation 3, R is the gas constant 1.987 cal/°K., the temperature is in degrees Kelvin where T designates the temperature at which the conversion takes place and $T_{ref}$ is 658.2° K., and 35,000 cal is the activation energy for hydrocracking. The catalyst activities certain of the catalysts from Table 2 is given below in Table 3.

TABLE 3

| Catalyst | Activities HDN | Polyaromatic Saturation | Hydrocracking |
|---|---|---|---|
| A | 1.1 | 2.3 | None |
| B | 1.3 | 2.0 | 1.2 |
| C | 1.2 | 2.0 | 1.3 |
| D | 1.0 | 1.0 | 1.0 |
| E | 1.3 | 1.0 | 0.5 |
| F | 0.4 | 0.4 | 0.4 |
| Commercial (I) | 0.6 | 0.3 | 1.0 |
| Commercial (II) | 1.0 | 1.6 | None |

An inspection of Table 3 shows that for each of the activities, CoMo on 35% USY sieve dispersed in a $SiO_2$-$Al_2O_3$ matrix (Catalyst F) is the least active.

Further, the addition of 35% USY sieve (Catalyst B) or 50% USY sieve (Catalyst C) to NiW on $\gamma$-$Al_2O_3$ (Catalyst A) increased the HDN activity and hydrocracking activity. Catalysts B and C, therefore, are better for hydrodenitrogenation than are traditional non-sieve-containing hydrodenitrogenation catalysts (such as Catalyst A, and the commercial (II) catalyst).

Catalysts D and B are identical (2% NiO, 18% $WO_3$ and 35% USY) except for the support composition. The support for Catalyst B in accordance with the present invention, contains $\gamma$-$Al_2O_3$, while the support for Catalyst D contains silica-alumina. The hydrodenitrogenation and hydrocracking activities for Catalyst B (1.3 and 1.2, respectively) are higher than those for Catalyst D (1.0 and 1.0). In addition Catalyst B has a much higher polyaromatic saturation activity (2.0) than Catalyst D (1.0). For each of these reactions, $\gamma$-$Al_2O_3$ in accordance with the invention is a preferred support component when nickel and tungsten are used as hydrogenation components.

Commercial hydrodenitrogenation catalysts most often contain NiMo or phosphorus-promoted NiMo supported on $\gamma$-$Al_2O_3$. As can also be seen from Table 3, NiW and NiMo are equally active for hydrodenitrogenation. For example, the hydrodenitrogenation activity of Catalyst A (NiW) and the commercial (II) catalyst are 1.1 and 1.0 respectively. Both Catalyst A and the commercial (II) catalyst are nonsieve catalysts with the metals supported on $\gamma$-$Al_2O_3$. Similarly, the hydrodenitrogenation activities for Catalyst B (NiW) and Catalyst E (NiMo) are the same. Both catalysts B and E, had the same support, namely: 35% USY sieve dispersed in $\gamma$-$Al_2O_3$. However, while the hydrodenitrogenation activities for Catalysts B and E are the same, the hydrocracking activity for Catalyst B is substantially higher (1.2 vs. 0.5) than that of Catalyst E. This test also shows that at the same molecular sieve level and with the same support, the use of NiW, in accordance with the present invention, is much more effective for hydrocracking than is the use of NiMo as the hydrogenation component.

The product selectivities for several comparative catalysts and the catalysts containing nickel, tungsten, alumina, and a molecular sieve components in accordance with the hydrocracking stage of the present invention were determined. Table 4 below sets out the reaction conditions, conversion, and selectivities for each test run. The reactor catalyst loadings are also set out. The WHSV was adjusted to give about the same conversion for each test run.

TABLE 4

| Run No. | 1 | 2 | 3 |
|---|---|---|---|
| Catalyst loading, g: | 6.25B<br>12.50C | 18.75B | 18.75 commercial (I) |
| Operating Conditions: | | | |
| Pressure, psi | 1250 | 1250 | 1250 |
| Temperature, °F. | 712 | 706 | 703 |
| WHSV, hr-1 | 1.57 | 1.66 | 1.44 |
| Wt. % Conversion to less than 380° F. | 77.1 | 76.7 | 76.6 |
| Product Selectivity, wt. % | | | |
| $C_1$–$C_3$ | 3.08 | 2.68 | 3.49 |
| $C_4$ | 8.07 | 8.13 | 8.21 |
| $C_5$ | 7.27 | 7.09 | 7.61 |
| $C_6$–180° F. naphtha | 11.98 | 11.72 | 11.43 |
| 180–380° F. naphtha | 46.71 | 47.16 | 45.84 |
| 380°+ | 22.90 | 23.30 | 23.40 |

| Run No. | 4 | 5 | 6 | 7 |
|---|---|---|---|---|
| Catalyst loading, g: | 6.25D<br>12.50F | 18.75H | 18.75G | 6.25B<br>12.50F |
| Operating Conditions: | | | | |
| Pressure, psi | 1250 | 1250 | 1250 | 1250 |
| Temperature, °F. | 724 | 726 | 701 | 716 |
| WHSV, hr-1 | 1.57 | 1.58 | 1.69 | 1.63 |
| Wt. % Conversion to less than 380° F. | 76.9 | 76.0 | 77.0 | 76.0 |
| Product Selectivity, Wt. % | | | | |
| $C_1$–$C_3$ | 3.93 | 3.55 | 2.47 | 3.28 |
| $C_4$ | 8.58 | 8.22 | 8.15 | 8.08 |
| $C_5$ | 7.93 | 7.61 | 7.44 | 7.54 |
| $C_6$–180° F. naphtha | 11.50 | 11.62 | 12.67 | 11.60 |
| 180–380° F. naphtha | 44.93 | 44.96 | 46.20 | 45.55 |
| 380°+ | 23.10 | 24.00 | 23.00 | 24.00 |

The following Table 5 below sets out the product analysis for each test run in Table 4 above.

TABLE 5

| Product Analysis | | | |
|---|---|---|---|
| Run No. | 1 | 2 | 3 |
| Total product | | | |
| API gravity | 52.1 | 52.7 | 48.8 |
| % C | 86.13 | 85.90 | 86.70 |
| % H | 13.87 | 14.10 | 13.30 |
| Total aromatics, wt % | 20.6 | 15.0 | 32.5 |
| Polyaromatics, wt % | 0.1 | 0.0 | 0.3 |
| Naphtha | | | |
| API gravity | 53.8 | 55.4 | 51.0 |
| % C | 86.26 | 85.99 | 86.76 |
| % H | 13.74 | 14.01 | 13.24 |
| Paraffins, wt % | 31.4 | 33.8 | 30.3 |
| Naphthenes, wt % | 49.9 | 52.6 | 41.0 |
| Aromatics, wt % | 18.7 | 13.6 | 28.7 |
| Distillate | | | |
| API gravity | 39.3 | 40.1 | 35.9 |
| % C | 86.77 | 86.42 | 88.12 |
| % H | 12.23 | 13.58 | 12.62 |
| Total aromatics, wt % | 31.3 | 20.2 | 48.4 |
| Polyaromatics, wt % | 1.1 | 1.0 | 2.7 |

| Run No. | 4 | 5 | 6 | 7 |
|---|---|---|---|---|
| Total product | | | | |
| API gravity | 40.5 | 49.7 | 51.8 | 51.1 |
| % C | 86.80 | 86.75 | 85.95 | 85.54 |
| % H | 13.20 | 13.24 | 14.05 | 13.46 |
| Total aromatics, wt % | 36.0 | 31.9 | 14.4 | 30.1 |
| Polyaromatics, wt % | 0.4 | 0.3 | 0.4 | 0.2 |
| Naphtha | | | | |
| API gravity | 56.8 | 51.3 | 57.2 | 55.4 |
| % C | 86.45 | 86.84 | 85.93 | 86.24 |
| % H | 13.55 | 13.16 | 14.07 | 13.76 |
| Paraffins, wt % | 39.3 | 31.6 | 35.2 | 36.3 |
| Naphthenes, wt % | 31.2 | 39.6 | 51.9 | 38.4 |
| Aromatics, wt % | 29.5 | 28.8 | 13.0 | 25.3 |
| Distillate | | | | |
| API gravity | 35.6 | 35.6 | 41.4 | 37.5 |
| % C | 87.79 | 87.38 | 86.38 | 87.43 |
| % H | 12.21 | 12.62 | 13.62 | 12.57 |
| Total aromatics, wt % | 56.0 | 49.6 | 17.0 | 46.7 |
| Polyaromatics, wt % | 3.3 | 3.0 | 1.1 | 2.6 |

As is evident from the above Table 4, when operated at the same conversion, the commercial catalyst (I) is less naphtha selective than the catalysts exemplified in runs 1, 2 and 6. The commercial catalyst also has a higher selectivity to undesirable $C_1$–$C_5$ light gas products. Also, the process exemplified in runs 1, 2, and 6 was more naphtha selective than the processes exemplified in comparative runs 4, 5, and 7. Specifically, the catalyst blend used in run 4 contained $\frac{1}{3}$ catalyst D and $\frac{2}{3}$ catalyst F. Catalyst D contained silica-alumina in its support not in accordance with the present invention, while catalyst F contained Co, Mo, and silica-alumina not in accordance with the present invention. Catalyst H, used in run 5, contained Mo not in accordance with the invention and displayed a lower naphtha yield than the process of the invention. Additionally, in run 7 where ⅔ of the catalyst blend was catalyst F, the naphtha yield was similarly lower. All of the light gas yields for the invention catalysts were also lower than those determined in comparative runs 4, 5, and 7.

The distillate fractions prepared using the catalysts exemplified in runs 1, 2, and 6 have markedly lower aromatics contents than the distillate fractions yielded by the comparative processes rendering the fractions prepared in runs 1, 2, and 6 suitable for the use in preparing diesel fuel and jet fuel.

EXAMPLE 2

Two different feedstocks, in particular, light catalytic cycle oils, designated as A and B having the properties set out in Table 6 were hydrotreated by two different hydrotreating catalysts. Feedstock A was hydrotreated with commercially available hydrotreating catalyst containing nickel and molybdenum supported on alumina, while feedstock B was treated with a commercially available hydrotreating catalyst containing nickel and tungsten supported on alumina. The hydrotreating was carried out at hydrotreating conditions including 650° F., 800 psig hydrogen, and a weight hourly space velocity of 1.0.

TABLE 6

| | Feedstock Properties | |
|---|---|---|
| | A | B |
| C, Wt. % | 89.15 | 88.60 |
| H, Wt. % | 10.18 | 10.37 |
| API Gravity | 19.9 | 21.9 |
| S, Wt. % | .430 | .55 |
| N, ppm | 340 | 538 |
| Paraffins, Wt. % | 30.0 | 30.0 |
| Total Aromatics, Wt. % | 70.0 | 70.0 |
| Naphthalene, Wt. % | 34.0 | 26.0 |
| Phenanthrene, Wt. % | 5.5 | 5.5 |
| Distillation, °F. | | |
| 5 Wt. % | 454 | 391 |
| 10 Wt. % | 478 | 417 |
| 30 Wt. % | 513 | 476 |
| 50 Wt. % | 534 | 530 |
| 70 Wt. % | 562 | 593 |
| 90 Wt. % | 609 | 661 |
| 95 Wt. % | 655 | 686 |
| 99 Wt. % | — | 726 |
| FBP | — | 741 |

Hydrotreated feedstocks A and B were then blended in equal volume amounts to form feedstock C. Also, a blend of the hydrotreated feedstock C along with feedstock B was prepared on an equal volume basis to form feedstock D. Table 7 sets out the properties of the hydrotreated feedstocks blend, feedstock C, and the blend of hydrotreated feedstock C and nonhydrotreated feedstock B, i.e., feedstock D.

TABLE 7

| | Feedstock Properties | |
|---|---|---|
| Feedstock | C | D |
| C, Wt. % | 88.09 | 88.40 |
| H, Wt. % | 11.66 | 11.03 |
| API Gravity | 26.2 | 24.1 |
| S, Wt. % | 0.04 | 0.33 |
| N, ppm | 19 | 300 |
| Parraffins, Wt. % | 38.2 | 33.6 |
| Total Aromatics, Wt. % | 63.8 | 66.4 |
| Naphthalene, Wt. % | 1.0 | 3.2 |
| Distillation, °F. | | |

TABLE 7-continued

| | Feedstock Properties | |
|---|---|---|
| Feedstock | C | D |
| 5 Wt. % | 372 | 385 |
| 10 Wt. % | 409 | 412 |
| 30 Wt. % | 472 | 474 |
| 50 Wt. % | 513 | 519 |
| 70 Wt. % | 562 | 573 |
| 90 Wt. % | 625 | 641 |
| 95 Wt. % | 653 | 667 |
| 99 Wt. % | 701 | 709 |
| FBP | 717 | 722 |

The process of the invention was compared with a comparative, alternative process. In accordance with the invention, feedstocks C and D were hydrocracked in a hydrocracking stage. The comparative process was carried out by charging nonhydrotreated feedstock B to the same hydrocracking stage.

Table 8 below sets out the catalyst composition of the catalyst employed in the process of the invention hydrocracking stage.

TABLE 8

| | |
|---|---|
| Chemical Composition, wt % | |
| $WO_3$ | 17.78 |
| NiO | 1.90 |
| $Na_2O$ | .13 |
| $SO_4$ | .29 |
| Support Composition, wt % | |
| Alumina | 65 |
| Crystalline molecular Sieve, USY | 35 |
| Surface Properties | |
| S.A., $m^2/g$ | 350 |
| Unit Cell Size | 24.51 |
| Crystallinity, % | 94 |
| Physical Properties | |
| Density, $lbs/ft^3$ | 49.7 |
| Crush Strength, lbs/mm | 7.4 |
| Abrasion Loss, wt % (1 hr) | 1.2 |

The hydrocracking stage of the process of the invention was carried out on a "once-through" basis at 1250 psig, at a hydrogen flow rate of 12,000 SCFB and the various liquid hourly space velocities set out below in Table 9. Reactor temperature was adjusted to maintain 77 wt. % conversion of the feed material boiling above 380° F. to material boiling below 380° F.

The hydrocracking step carried out in connection with the comparative process wherein feedstock B was charged to the reactor was carried out at the same conditions. Products from each run were analyzed every day for conversion and product distribution. Table 9 below sets out the catalyst analyst activity data after the reactor temperature reached a steady-state value (corrected to 77 wt. % conversion) for the process of the invention, and the comparative process wherein the feed to the hydrocracking stage had not been hydrotreated.

TABLE 9

| | Hydrocracking Activity (Temperature Of At 77% Conversion) | | |
|---|---|---|---|
| Run | Feedstock | LHSV | TEMP, °F. |
| 1 | B | 1.2 | 705 |
| 2 | C (INV) | 1.2 | 634 |
| 3 | C (INV) | 1.8 | 660 |
| 4 | D (INV) | 1.6 | 711 |
| 5 | B | 1.6 | 725 |

TABLE 9-continued

| Hydrocracking Activity (Temperature Of At 77% Conversion) | | | |
|---|---|---|---|
| Run | Feedstock | LHSV | TEMP, °F. |
| 6 | C (INV) | 1.6** | 651 |

**Calculated by linear interpolation of LHSV between 1.2 and 1.8.

These data emphatically demonstrate that when the feed to the hydrocracking zone is hydrotreated or at least a portion of it is hydrotreated, a considerably lower temperature is required to maintain 77 wt. % conversion. For instance, feedstock C, in accordance with the invention where all of the feed is hydrotreated prior to hydrocracking, the temperature for the subject conversion is about 71° F. lower than the temperature required to convert feedstock B which has not been hydrotreated. Further, advantageously when the liquid hourly space velocity was increased by 50% to 1.8, the temperature required to maintain the desired conversion is still about 45° F. lower than the comparative case wherein the feed is not first hydrotreated.

In the case where the equal volume blend of hydrotreated feed and nonhydrotreated feed is used, feedstock D, the activity advantage was afforded at the higher space velocity (1.6 LHSV). The temperature required to maintain 77 wt. % conversion for feedstock D was about 14° F. lower than the temperature required to convert the nonhydrotreated feedstock B.

The following Table 10 sets out the distribution in weight percent of the constituents of the naphtha or $C_6$+ fraction for products obtained in invention Runs 2, 3 and 4 and comparative Run 1.

TABLE 10

| | Naphtha Consitituents, Wt. % | | | |
|---|---|---|---|---|
| RUN | 1 | 2 | 3 | 4 |
| Paraffins | 4.92 | 3.96 | 4.11 | 4.80 |
| C-6 | 1.93 | 1.69 | 1.80 | 2.01 |
| C-7 | 1.09 | 0.83 | 0.85 | 1.05 |
| C-8 | 0.77 | 0.58 | 0.55 | 0.70 |
| C-9 | 0.53 | 0.41 | 0.44 | 0.45 |
| C-10 | 0.36 | 0.30 | 0.33 | 0.39 |
| C-11 | 0.16 | 0.11 | 0.09 | 0.13 |
| C-12+ | 0.08 | 0.40 | 0.05 | 0.07 |
| Isoparaffins | 24.42 | 24.12 | 24.79 | 24.76 |
| I-6 | 6.84 | 7.27 | 8.67 | 7.77 |
| I-7 | 5.15 | 5.27 | 5.78 | 5.59 |
| I-8 | 4.34 | 4.34 | 4.42 | 4.51 |
| I-9 | 3.48 | 3.39 | 3.12 | 3.35 |
| I-10 | 2.71 | 2.62 | 1.99 | 2.34 |
| I-11 | 1.25 | 0.90 | 0.53 | 0.78 |
| I-12+ | 0.65 | 0.33 | 0.28 | 0.42 |
| Naphthenes | 56.04 | 55.52 | 52.37 | 53.03 |
| N-6 | 6.57 | 6.42 | 7.30 | 7.09 |
| N-7 | 13.39 | 13.77 | 14.34 | 14.07 |
| N-8 | 13.71 | 14.77 | 14.41 | 14.00 |
| N-9 | 10.75 | 11.19 | 9.93 | 10.14 |
| N-10 | 6.83 | 6.38 | 4.55 | 5.10 |
| N-11 | 3.14 | 2.19 | 1.20 | 1.69 |
| N-12+ | 1.65 | 0.80 | 0.64 | 0.94 |
| Aromatics | 14.63 | 16.41 | 18.72 | 17.41 |
| A-6 | 1.11 | 1.13 | 1.41 | 1.21 |
| A-7 | 3.09 | 3.85 | 4.78 | 5.21 |
| A-8 | 4.33 | 5.51 | 6.44 | 5.13 |
| A-9 | 3.48 | 4.16 | 4.30 | 3.87 |
| A-10 | 2.34 | 1.76 | 1.69 | 1.92 |
| A-11+ | 0.28 | 0.00 | 0.10 | 0.07 |
| Run Temp., °F. | 705 | 634 | 660 | 711 |

It is clear from the above table that the process of the invention results in a higher octane affording aromatics yield for the naphtha fraction.

Without wishing to be bound by theory it is surmised that the hydrotreating stage of the process of the invention partially hydrogenates the polyaromatics. Subsequently, in the hydrocracking stage the hydrogenated portion of the polyaromatic is preferentially cracked versus the further hydrogenation of the remaining aromatic ring(s), thus, preserving more aromatics in the product naphtha fraction over the comparative single stage hydrocracking process.

What is claimed is:

1. A multiple stage process for hydroconversion of a hydrocarbon feedstock containing nitrogen- and sulfur-containing compounds which comprises:

(a) contacting said feedstock in a hydrotreating stage comprising a hydrotreating reaction zone wherein hydrogen is contacted with said hydrocarbon feedstock in the presence of a hydrotreating catalyst at hydrotreating conditions wherein a substantial portion of the nitrogen- and sulfur-containing compounds are converted to hydrogen sulfide and ammonia;

(b) passing at least a portion of the effluent from said hydrotreating reaction zone to a stripping zone wherein a substantial portion of the hydrogen sulfide and ammonia is removed from the hydrotreating reaction zone effluent to form a stripping zone effluent;

(c) contacting at least a portion of said stripping zone effluent in a hydrocracking stage wherein said stripping zone effluent is contacted with hydrogen at hydrocracking conditions in the presence of a catalyst comprising a hydrogenation component comprising a nickel component and a tungsten component wherein the nickel component is present in an amount ranging from about 1 to about 10 wt. % and the tungsten component is present in an amount ranging from about 10 to about 30 wt. %, both calculated as oxides and based on the total catalyst weight and a support component consisting essentially of a crystalline molecular sieve component and an alumina component wherein the crystalline molecular sieve component is present in the support in an amount less than about 60 wt. % and greater than about 25 wt. % based on the total weight of the support component.

2. The process of claim 1 wherein said hydrogenation component also contains a phosphorus component present in an amount ranging from about 0.0 to 5.0 wt. % calculated as the oxide and based on total catalyst weight.

3. The process of claim 1 wherein said alumina component is gamma alumina.

4. The process of claim 1 wherein said crystalline molecular sieve component is a Y zeolite.

5. The process of claim 1 wherein said feedstock comprises light catalytic cycle oil that contains at least about 30 vol. % aromatics.

6. The process of claim 1 wherein said nickel component is present in an amount ranging from about 1.5 to about 5.0 wt. %, said tungsten component is present in an amount ranging from about 15 to about 25 wt. %, both calculated as oxides, and said crystalline molecular sieve component is present in an amount less than about 50 wt. % and greater than about 35 wt. % based on the total weight of said support component.

7. The process of claim 6 wherein said hydrogenation component also contains a phosphorus component present in an amount ranging from about 0.0 to 2.0 wt. % calculated as the oxide and based on total catalyst weight.

8. The process of claim 6 wherein said alumina component is gamma alumina.

9. The process of claim 6 wherein said crystalline molecular sieve component is a Y zeolite.

10. The process of claim 6 wherein said feedstock comprises light catalytic cycle oil that contains at least about 30 vol. % aromatics.

11. The process of claim 1 wherein said nickel component is present in an amount ranging from about 1.5 to about 4.0 wt. %, said tungsten component is present in an amount ranging from about 15 to about 20 wt. %, both calculated as oxides, and said crystalline molecular sieve component is present in an amount less than about 50 wt. % and greater than about 35 wt. % based on the weight support component.

12. The process of claim 11 wherein said hydrogenation component also contains a phosphorus component present in an amount ranging from about 0.0 to about 1.0 wt. % calculated as the oxide and based on total catalyst weight.

13. The process of claim 11 wherein said alumina component is gamma alumina.

14. The process of claim 11 wherein said crystalline molecular sieve component is a Y zeolite.

15. The process of claim 11 wherein said feedstock comprises light catalytic cycle oil that contains at least about 30 vol. % aromatics.

* * * * *